US009185477B2

(12) United States Patent
Kim et al.

(10) Patent No.: US 9,185,477 B2
(45) Date of Patent: Nov. 10, 2015

(54) SUSPENSION FOR SOUND TRANSDUCER

(71) Applicant: Em-Tech. Co., Ltd., Busan (KR)

(72) Inventors: Ji Hoon Kim, Gyeongsangnam-do (KR); Joong Hak Kwon, Busan (KR); Jung Hyung Lee, Gyeongsangnam-do (KW); Hyeon Taek Oh, Gyeongsangnam-do (KR)

(73) Assignee: EM-TECH Co., Ltd., Busan (KR)

( * ) Notice: Subject to any disclaimer, the term of this patent is extended or adjusted under 35 U.S.C. 154(b) by 0 days.

(21) Appl. No.: 14/031,365

(22) Filed: Sep. 19, 2013

(65) Prior Publication Data

US 2014/0321691 A1 Oct. 30, 2014

(30) Foreign Application Priority Data

Apr. 24, 2013 (KR) ..... 10-2013-0045488

(51) Int. Cl.
*H04R 7/16* (2006.01)
*H04R 1/00* (2006.01)
*H04R 31/00* (2006.01)

(52) U.S. Cl.
CPC .. *H04R 1/00* (2013.01); *H04R 7/16* (2013.01); *H04R 31/003* (2013.01)

(58) Field of Classification Search
CPC ..... H04R 7/00; H04R 7/02; H04R 7/06; H04R 7/10; H04R 7/12; H04R 7/122; H04R 7/125; H04R 7/127; H04R 7/14; H04R 7/16; H04R 7/18; H04R 7/20; H04R 7/24; H04R 31/003; H04R 2231/001; H04R 2231/003; H04R 2307/025; H04R 2307/027; H04R 2307/204; H04R 2307/207
USPC ..... 381/176, 178, 398, 399, 400, 409, 410, 381/423, 424, 426, 427, 430; 181/157, 164, 181/167, 168, 170–174
See application file for complete search history.

(56) References Cited

U.S. PATENT DOCUMENTS

| | | | | |
|---|---|---|---|---|
| 6,853,734 | B2 * | 2/2005 | Sahyoun | 381/404 |
| 7,283,636 | B2 * | 10/2007 | Nishimura et al. | 381/152 |
| 8,737,675 | B2 * | 5/2014 | Hiwatashi et al. | 381/409 |
| 2006/0215873 | A1 * | 9/2006 | Hansen et al. | 381/412 |
| 2013/0133975 | A1 | 5/2013 | Kim et al. | |

FOREIGN PATENT DOCUMENTS

| | | | | |
|---|---|---|---|---|
| EP | 1 128 705 | | 8/2001 | |
| EP | 1128705 | * | 8/2001 | H04R 9/04 |
| EP | 2 490 461 | | 8/2012 | |
| JP | 09-307993 | | 11/1997 | |
| WO | WO 2012-023709 | * | 2/2012 | H04R 7/16 |

OTHER PUBLICATIONS

Extended European Search Report for European Application No. 13004360.7 (Nov. 14, 2013).

* cited by examiner

*Primary Examiner* — Ahmad F Matar
*Assistant Examiner* — Sabrina Diaz
(74) *Attorney, Agent, or Firm* — Murphy, Bilak & Homiller, PLLC

(57) ABSTRACT

The present invention relates to a suspension for a sound transducer. The present invention discloses a suspension for a sound transducer, to which a diaphragm and voice coil of the sound transducer are attached and which guides the vibrations of the diaphragm and voice coil, comprising: a central portion to which a voice coil is attached; an outer peripheral portion resting on a frame; and a connecting portion connecting the central portion and the outer peripheral portion, wherein the central portion has a mold portion, which is molded by heat or pressure to take the place of a center diaphragm.

9 Claims, 6 Drawing Sheets

SUSPENSION FOR SOUND TRANSDUCER

TECHNICAL FIELD

The present invention relates to a suspension for a sound transducer.

BACKGROUND ART

FIG. 1 is a view showing an example of a conventional sound transducer.

A yoke 21, an inner ring magnet 22, an outer ring magnet 23, an inner ring top plate 24, and an outer ring top plate 25 are installed within a frame 10, and a voice coil 30 is placed in an air gap between the inner ring magnet 22 and the outer ring magnet 23 and vibrates vertically when power is applied to the voice coil 30. The voice coil 30 is mounted to the bottom side of a suspension 40, and a side diaphragm 51 and a center diaphragm 52 are installed on the top and bottom sides of the suspension 40 and vibrate in synchrony with the vibration of the voice coil 30, producing a sound. A protector 60 is connected to the top of the side diaphragm 51 and center diaphragm 52 to protect the parts located inside a speaker. The protector 60 includes a ring-shaped steel portion 61 with an opening in the middle to emit a sound, and a ring-shaped injection portion 62, through which the steel portion 61 is inserted and injection-molded and which is laminated on top of the frame 10, the outer periphery of the side diaphragm 51, and the outer periphery of the suspension 40. In order to separately bond the center diaphragm 52, a bonding surface for attaching the suspension 40 and the center diaphragm 52 is required, and a bonding layer is required between the suspension 40 and the center diaphragm 52, thus causing an increase in laminate thickness and large deviations in operation.

FIG. 2 is a view showing another example of a conventional sound transducer. This sound transducer is identical to the conventional sound transducer of FIG. 1 in that a yoke 21, an inner ring magnet 22, an outer ring magnet 23, an inner ring top plate 24, and an outer ring top plate 25 are installed within a frame 10, a voice coil 30 is placed in an air gap between the inner ring magnet 22 and the outer ring magnet 23, and the voice coil 30 is mounted to the bottom side of a suspension 40'. However, this sound transducer is different from the conventional sound transducer of FIG. 1 in that no center diaphragm is manufactured and attached separately, but instead the central portion of the suspension 40' serves as the center diaphragm because it is not perforated. The side diaphragm 51 is attached to the top and bottom sides of the suspension, and a protector 60 is also provided to protect the parts located within a speaker. In the case that the central portion of the suspension 40' takes the place of a center diaphragm, it lowers sound pressure due to its heavy weight. In addition, if the suspension is made thinner to reduce the weight, it weakens the rigidity of the suspension and therefore causes dips in sound pressure at high frequencies, resulting in deterioration of acoustic characteristics.

DISCLOSURE OF THE INVENTION

An object of the present invention is to provide a suspension which reduces the laminate thickness of a sound transducer and which is rigid enough to enhance acoustic characteristics at high frequencies.

According to an aspect of the present invention for achieving the above objects, there is provided a suspension for a sound transducer, to which a diaphragm and voice coil of the sound transducer are attached and which guides the vibrations of the diaphragm and voice coil, comprising: a central portion to which a voice coil is attached; an outer peripheral portion resting on a frame; and a connecting portion connecting the central portion and the outer peripheral portion, wherein the central portion has a mold portion, which is molded by heat or pressure to take the place of a center diaphragm.

In addition, the suspension includes a base film, a conductive pattern attached to both sides of the base film, and a cover layer attached on the conductive pattern, and at least one of the conductive pattern and cover layer attached on at least one side of the mold portion is removed.

Moreover, the base film is made of any one of a PI film, a PEI-F film, a PEEK film, and a PEN film.

Additionally, the cover layer is made of any one of a PI film, a PEI-F film, a PEEK film, and a PEN film.

Furthermore, the suspension has a bonding portion formed inside a voice coil attachment position to bond the lead wire of the voice coil, and the suspension has an escape portion provided at the voice coil attachment position, which is formed by removing a predetermined size of conductive pattern and cover layer so as to take out the lead wire of the voice coil towards the bonding portion without interference.

Still furthermore, the mold portion includes a forward dome portion that projects upward and a reverse dome portion that projects downward.

Still furthermore, the suspension has a bonding portion formed in the central portion to bond the lead wire of the voice coil, and the mold portion is formed avoiding the bonding portion.

Still furthermore, the suspension has a bonding portion formed inside a voice coil attachment position to bond the lead wire of the voice coil, and the suspension has a perforated portion of a predetermined size formed at the voice coil attachment position so as to take out the lead wire of the voice coil towards the bonding portion without interference.

Still furthermore, the mold portion further includes an additional conductive pattern layer for increasing rigidity.

Still furthermore, the suspension consists of an FPCB, and an FPCB pattern is formed by etching or electrodeposition.

The suspension for the sound transducer provided by the present invention can improve the rigidity of the suspension's central portion serving as a center diaphragm since a mold portion is provided in the central portion in a forward dome shape or reverse dome shape, thereby improving acoustic characteristics at high frequencies.

In addition, the suspension for the sound transducer provided by the present invention can simplify the assembly process and reduce the overall laminate thickness of the sound transducer because it is not necessary to manufacture and attach a center diaphragm separately.

Moreover, the suspension for the sound transducer provided by the present invention can reduce the rate of defects caused by deviations in operation because it is not necessary to manufacture and attach a center diaphragm separately.

BEST MODE FOR CARRYING OUT THE INVENTION

Hereinafter, the present invention will be described in more detail with reference to the drawings.

Figure 1:
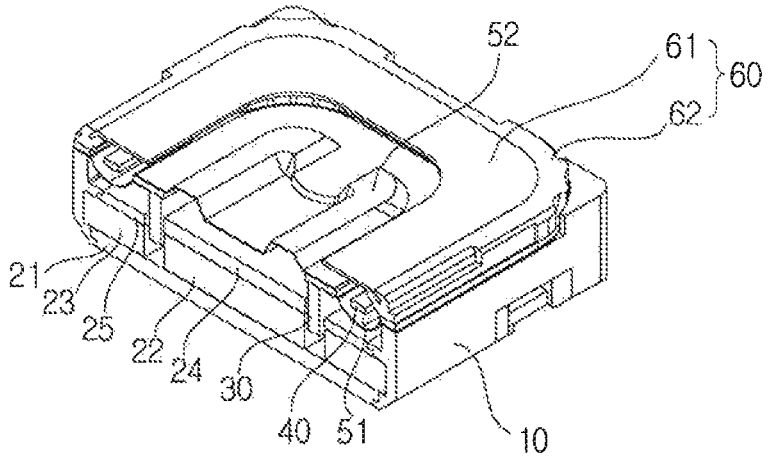
FIG. 1 (PRIOR ART)
FIG. 1 is a view showing an example of a conventional sound transducer.
Figure 2:
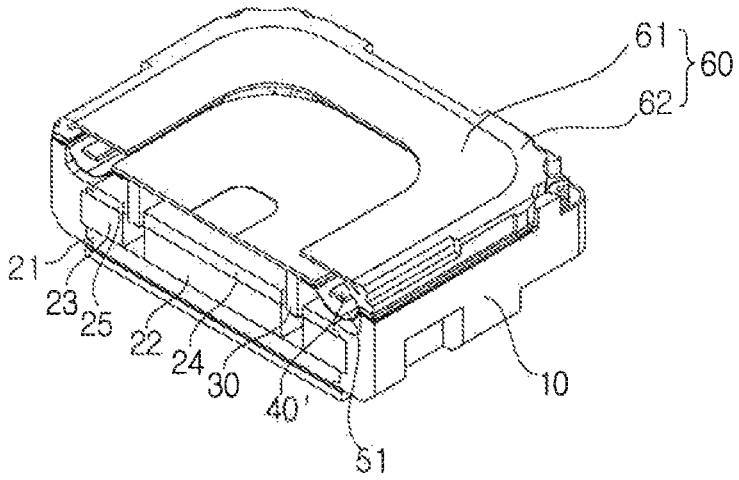
FIG. 2 (PRIOR ART)
FIG. 2 is a view showing another example of a conventional sound transducer.
Figure 3:
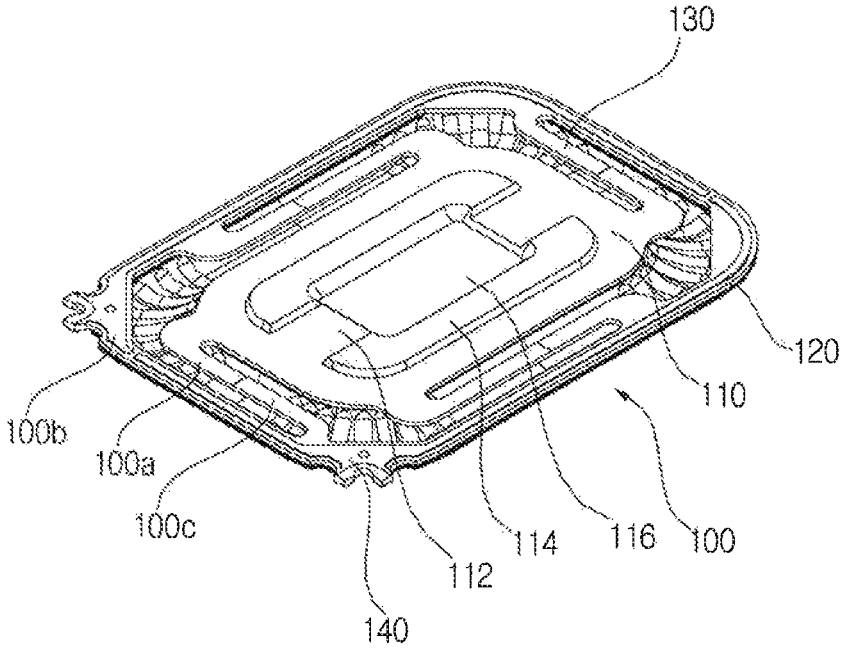
FIG. 3 is a view showing a suspension for a first embodiment of the present invention.

FIG. 3 is a view showing a suspension for a sound transducer according to a first embodiment of the present invention. The suspension 100 for the sound transducer according to the first embodiment of the present invention includes a central portion 110 to which the inner periphery of a side diaphragm (not shown) and a voice coil (not shown) are attached, an outer peripheral portion 120 resting on a frame (not shown), and a connecting portion 130 connecting the central portion 110 and the outer peripheral portion 120. The central portion 110 includes a flat surface 112 being flat and having the same height as the outer peripheral portion 120 and the connecting portion 130, a forward dome portion 114 projecting upward from the flat surface 112, and a reverse dome portion 116 projecting downward from the flat surface 112. Here, the bottom side refers to the side where the voice coil 300 is attached, and the top side refers to the side of a protector (not shown) of the sound transducer. In the first embodiment of the present invention shown in FIG. 3, the reverse dome portion 116 is formed at the center of the central portion 110, and the forward dome portion 114 is provided in pair to surround both sides of the reverse dome portion 116. The forward dome portion 114 and the reverse dome portion 116 may be arranged in a reverse order, and the design of the forward dome portion 114 and reverse dome portion 116 may be changed regardless of the first embodiment, including their number of units and their shape. Otherwise, the forward dome portion 114 alone or the reverse dome portion 116 alone may be formed.

The suspension 100 consists of an FPCB, and a conductive pattern layer 100*b* is formed in a predetermined pattern on a base film 100*a*, and a cover layer 100*c* is attached onto the conductive pattern layer 100*b*. The conductive pattern layer 100*b* is formed in pair to transmit positive and negative electrical signals and extends from a terminal bonding portion 140 formed at one side of the outer peripheral portion 120 to a bonding portion 150, which is to be described later, formed inside the central portion 110 through the outer peripheral portion 120, the connecting portion 130, and the central portion 110. The pattern of the FPCB may be formed by etching or electrodeposition.

Figure 4:
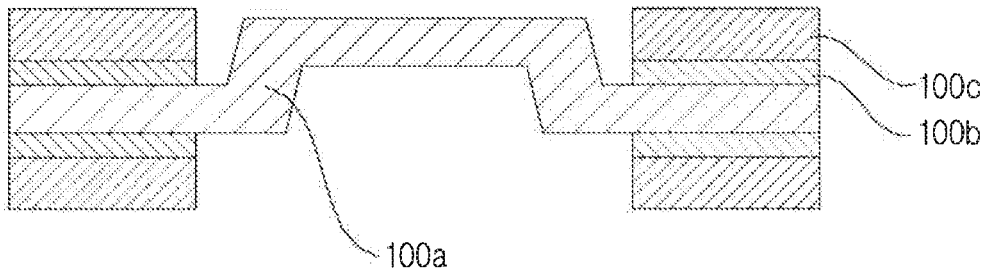
FIG. 4 is a view showing a suspension for a sound transducer according to a second embodiment of the present invention.

FIG. 4 is a view showing a laminated section of a suspension for a sound transducer according to a second embodiment of the present invention. The suspension for the sound transducer according to the present invention is manufactured by forming a conductive pattern layer 100*b* such as Cu on both sides of a base film 100*a* made of a PI film, a PEI-F film, a PEEK film, or a PEN film, and forming a cover layer 100*c* likewise made of a PI film, a PEI-F film, a PEEK film, or a PEN film on the conductive pattern layer 100*b*. In the suspension 100 for the sound transducer according to the second embodiment of the present invention, both the conductive pattern layer 100*b* and the cover layer 100*c* are removed from the upper and lower surfaces of a mold portion including the forward dome portion 114 and the reverse dome portion 116. Accordingly, the mold portion of the suspension 100 is made only of the base film 100*a*.

Figure 5:
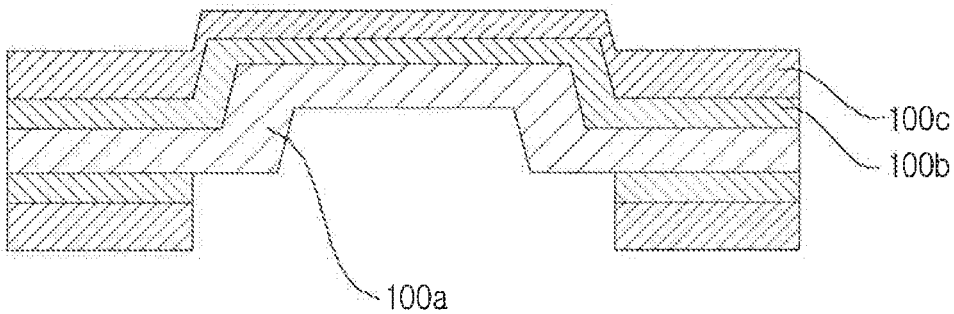
FIG. 5 is a view showing a laminated section of a suspension for a sound transducer according to a third embodiment of the present invention.

FIG. 5 is a view showing a laminated section of a suspension for a sound transducer according to a third embodiment of the present invention. This embodiment is identical to the second embodiment in that the suspension for the transducer is manufactured by forming a conductive pattern layer 100*b* such as Cu on both sides of a base film 100*a* and forming a cover layer 100*c* on the conductive pattern layer 100*b*. In the suspension for the sound transducer according to the third embodiment of the present invention, only the conductive pattern layer 100*b* and cover layer 100*c* attached on the lower surface of a mold portion are removed. Accordingly, the top side of the suspension for the sound transducer exposes the cover layer 100*c*, and the bottom side thereof exposes the base film 100*a*.

Figure 6:
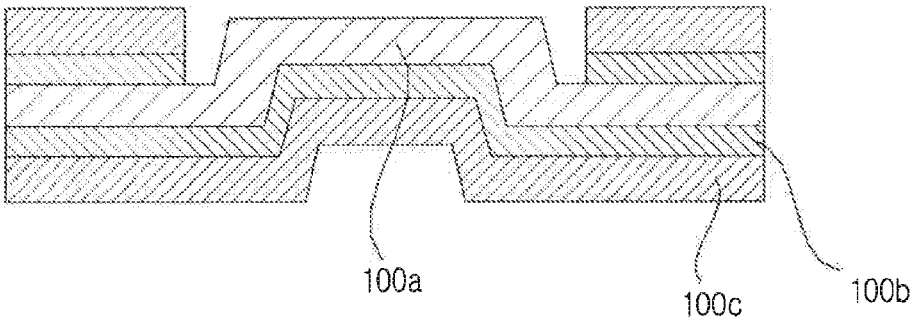
FIG. 6 is a view showing a laminated section of a suspension for a sound transducer according to a fourth embodiment of the present invention.

FIG. 6 is a view showing a laminated section of a suspension for a sound transducer according to a fourth embodiment of the present invention. This embodiment is identical to the second and third embodiments in that the suspension for the transducer is manufactured by forming a conductive pattern layer 100*b* such as Cu on both sides of a base film 100*a* and forming a cover layer 100*c* on the conductive pattern layer 100*b*. In the suspension for the sound transducer according to the fourth embodiment of the present invention, only the conductive pattern layer 100*b* and cover layer 100*c* attached on the upper surface of a mold portion are removed. Accordingly, the bottom side of the suspension for the sound transducer exposes the cover layer 100*c*, and the top side thereof exposes the base film 100*a*.

Figure 7:
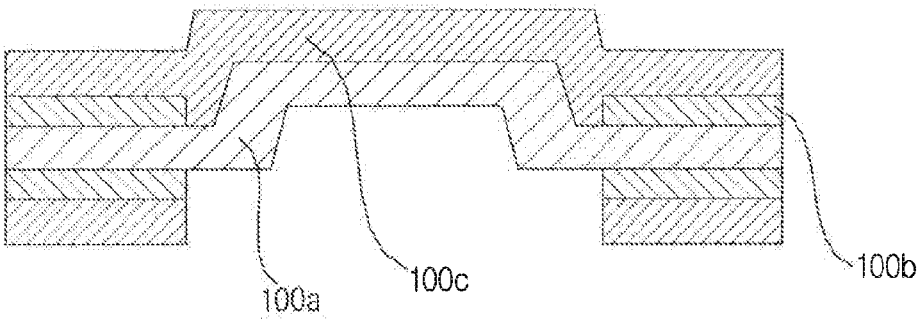
FIG. 7 is a view showing a laminated section of a suspension for a sound transducer according to a fifth embodiment of the present invention.

FIG. 7 is a view showing a laminated section of a suspension for a sound transducer according to a fifth embodiment of the present invention. This embodiment is identical to the second to fourth embodiments in that the suspension for the transducer is manufactured by forming a conductive pattern layer 100*b* such as Cu on both sides of a base film 100*a* and forming a cover layer 100*c* on the conductive pattern layer 100*b*. In the suspension for the sound transducer according to the fifth embodiment of the present invention, both the conductive pattern layer 100*b* and the cover layer 100*c* are removed from the lower surface of a mold portion, and only the conductive pattern layer 100*b* is removed from the upper surface thereof. Accordingly, the top side of the suspension for the sound transducer exposes the cover layer 100*c*, and the bottom side thereof exposes the base film 100*a*.

Figure 8:
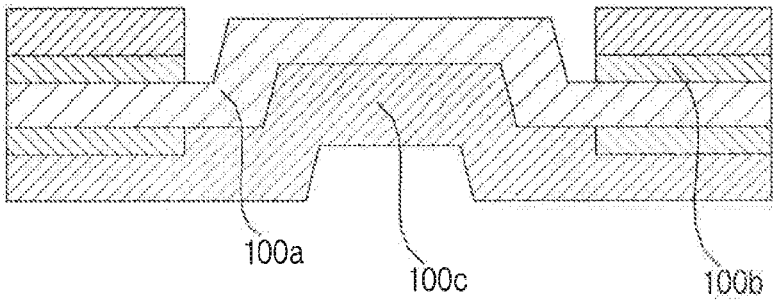
FIG. 8 is a view showing a laminated section of a suspension for a sound transducer according to a sixth embodiment of the present invention.

FIG. 8 is a view showing a laminated section of a suspension for a sound transducer according to a sixth embodiment of the present invention. This embodiment is identical to the second to fifth embodiments in that the suspension for the transducer is manufactured by forming a conductive pattern layer 100*b* such as Cu on both sides of a base film 100*a* and forming a cover layer 100*c* on the conductive pattern layer 100*b*. In the suspension for the sound transducer according to the sixth embodiment of the present invention, both the conductive pattern layer 100*b* and the cover layer 100*c* are removed from the upper surface of a mold portion, and only the conductive pattern layer 100*b* is removed from the lower surface thereof. Accordingly, the bottom side of the suspension for the sound transducer exposes the cover layer 100*c*, and the top side thereof exposes the base film 100*a*.

The second to sixth embodiments of the present invention relate to a laminated section of a mold portion of a suspension for a sound transducer. These embodiments may be applied in conjunction with any one of the first, seventh and eighth embodiments regarding the shape of the suspension.

Figure 9:
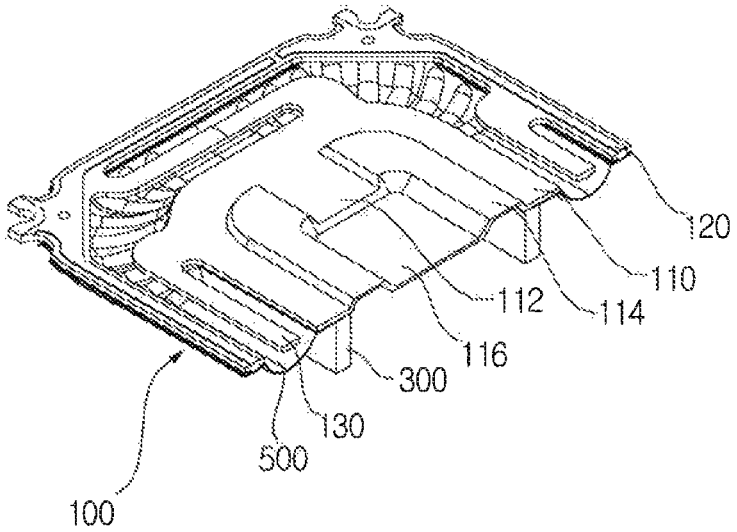
FIG. 9 and FIG. 10 are views showing a laminated section of a suspension for a sound transducer according to a seventh embodiment of the present invention.
Figure 10:
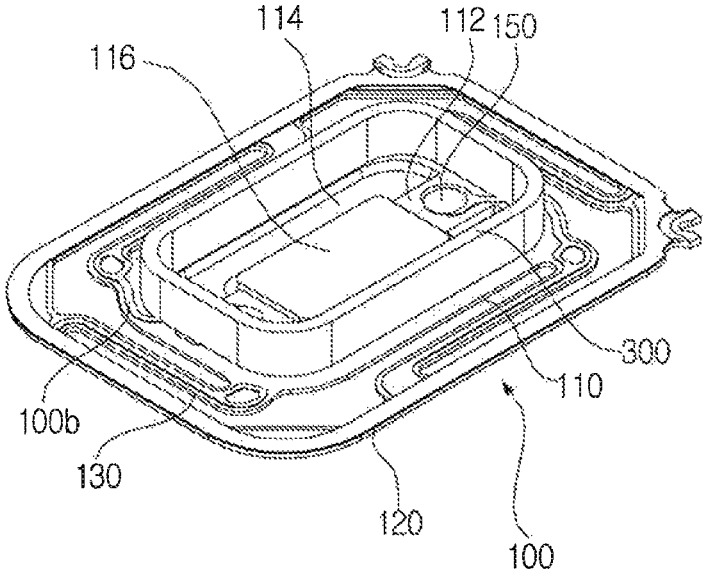

FIG. 9 and FIG. 10 are views showing a suspension for a sound transducer according to a seventh embodiment of the present invention. In the suspension for the sound transducer according to the seventh embodiment of the present invention, the suspension 100 for the sound transducer according to the first embodiment of the present invention includes a central portion 110 to which the inner periphery of a side diaphragm 500 and a voice coil (not shown) are attached, an outer peripheral portion 120 resting on a frame (not shown), and a connecting portion 130 connecting the central portion 110 and the outer peripheral portion 120. The central portion 110 includes a flat surface 112 being flat and having the same height as the outer peripheral portion 120 and the connecting portion 130, a forward dome portion 114 projecting upward from the flat surface 112, and a reverse dome portion 116 projecting downward from the flat surface 112. The forward dome portion 114 is formed in pair with a space between them so as to be symmetrical with respect to the long axis, and the reverse dome portion 116 is formed between the pair of forward dome portions 114. If the long axis is defined as the longitudinal direction, the length of the reverse dome portion 116 is smaller than the length of the forward dome portion 114, and therefore the flat surface 112, as well as the reverse dome portion 116, is formed between the pair of forward dome portion 114. That is, the flat surface 112 consists of an outer periphery of the central portion 110, to which a voice coil 300 is attached, and a portion extended to a predetermined length between the outer periphery and the forward dome portion 114.

A bonding portion 150 for bonding the lead wire of the voice coil 300 is formed on the flat surface 112 on the bottom side of the suspension 100. Particularly, the bonding portion 150 is formed in extended regions between the forward dome portions 114 on the flat surface 112. The lead wire of the voice coil 300 is taken out towards the inside of the voice coil 300 and bonded to the bonding portion 150, so that electrical signals are transmitted to the voice coil 300 by a conductive pattern layer 100*b* running from the terminal bonding portion 140 (see FIG. 3) to the bonding portion 150.

Figure 11:
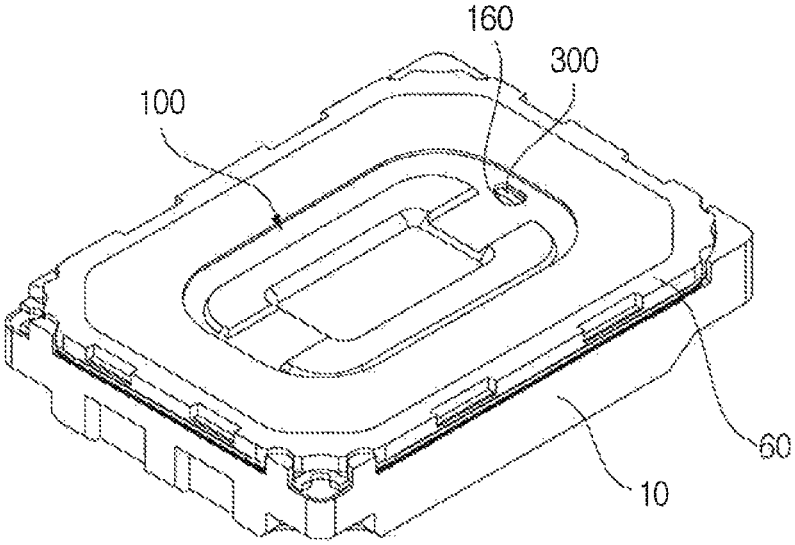
FIG. 11 is a view showing a sound transducer including a suspension according to an eighth embodiment of the present invention.

FIG. 11 is a view showing a sound transducer including a suspension according to an eighth embodiment of the present invention. In the suspension 100 according to the eighth embodiment of the present invention, a perforated portion 160 of a predetermined size is formed at a voice coil attachment position, so that the lead wire of the voice coil 300 is taken out towards the bonding portion 150 (see FIG. 10) without interference, when the bonding portion 150 (see FIG. 10) is provided on the flat surface 112 (see FIG. 10) of the central portion 110 (see FIG. 3) on the bottom side of the suspension 100, as in the seventh embodiment of the present invention. By forming a perforated portion 160 on a lead-out passage along which the lead wire of the voice coil is taken out from the voice coil 300 towards the bonding portion 150 (see FIG. 10), a number of problems are avoided, including deformation in the shape of the central portion 110 due to interference between the lead wire of the voice coil and the central portion 110 of the suspension.

Figure 12:
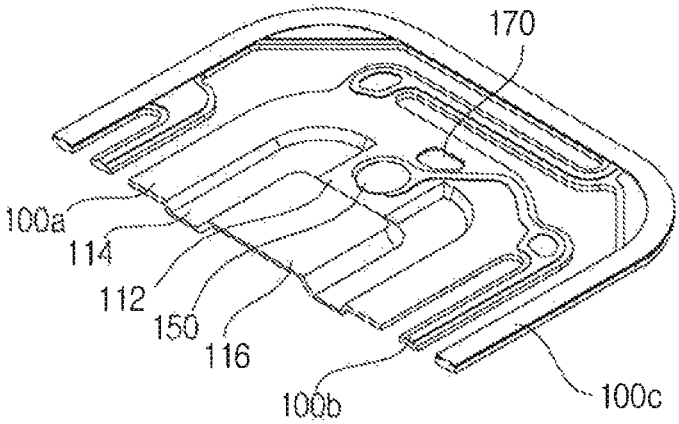
FIG. 12 is a view showing a suspension for a sound transducer according to a ninth embodiment of the present invention.

FIG. 12 is a view showing a suspension for a sound transducer according to a ninth embodiment of the present invention. In the suspension 100 according to the ninth embodiment of the present invention, a removed portion 170, formed by removing a predetermined size of cover layer 100*c* or cover layer 100*c* and conductive pattern layer 100*c*, is formed at a voice coil attachment position, so that the lead wire of the voice coil 300 is taken out towards the bonding portion 150 (see FIG. 10) without interference, when the bonding portion 150 (see FIG. 10) is provided on the flat surface 112 (see FIG. 10) of the central portion 110 (see FIG. 3) on the bottom side of the suspension 100, as in the seventh embodiment of the present invention. By forming a removed portion 170 on a lead-out passage along which the lead wire of the voice coil is taken out from the voice coil 300 towards the bonding portion 150 (see FIG. 10), a number of problems are avoided, including deformation in the shape of the central portion 110 due to interference between the lead wire of the voice coil and the central portion 110 of the suspension.

Figure 13:
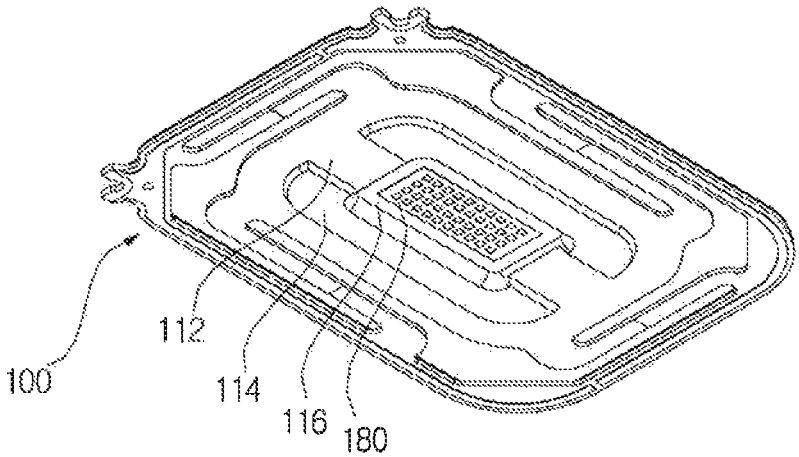
FIG. 13 is a view showing a suspension for a sound transducer according to a tenth embodiment of the present invention.

FIG. 13 is a view showing a suspension for a sound transducer according to a tenth embodiment of the present invention. The suspension 100 according to the tenth embodiment of the present invention can increase the rigidity of the reverse dome portion 116 and enhance acoustic characteristics at high frequencies, by providing an additional conductive pattern layer 180 on the reverse dome portion 116 formed in the central portion 110 (see FIG. 3) of the suspension 100. Although the additional conductive pattern layer 180 shown in the tenth embodiment has a lattice form, the additional conductive pattern layer 180 may be in different forms, such as a plurality of parallel fines, cross lines, etc, which can improve rigidity while minimizing an increase in weight.

What is claimed is:

1. A suspension for a sound transducer, to which a side diaphragm and a voice coil of the sound transducer are attached and which guides the vibrations of the side diaphragm and the voice coil, comprising:

a central portion to which the voice coil is attached;

an outer peripheral portion resting on a frame; and a connecting portion connecting the central portion and the outer peripheral portion, wherein the central portion has a mold portion, which is molded by heat or pressure, wherein the suspension comprises a base film, a conductive pattern attached to both sides of the base film, and a cover layer attached on the conductive pattern, and at least one of the conductive pattern and cover layer attached on at least one side of the mold portion is removed.

2. The suspension for the sound transducer as claimed in claim 1, wherein the base film is made of any one of a PI film, a PEI-F film, a PEEK film, and a PEN film.

3. The suspension for the sound transducer as claimed in claim 1, wherein the cover layer is made of any one of a PI film, a PEI-F film, a PEEK film, and a PEN film.

4. The suspension for the sound transducer as claimed in claim 1, wherein the suspension has a bonding portion formed inside a voice coil attachment position to bond the lead wire of the voice coil, and the suspension has an escape portion provided at the voice coil attachment position, which is formed by removing a predetermined size of conductive pattern and cover layer so as to take out the lead wire of the voice coil towards the bonding portion without interference.

5. The suspension for the sound transducer as claimed in claim 1, wherein the mold portion comprises a forward dome portion that projects upward and a reverse dome portion that projects downward.

6. The suspension for the sound transducer as claimed in claim 1, wherein the suspension has a bonding portion formed in the central portion to bond the lead wire of the voice coil, and the mold portion is formed avoiding the bonding portion.

7. The suspension for the sound transducer as claimed in claim 1, wherein the suspension has a bonding portion formed inside a voice coil attachment position to bond the lead wire of the voice coil, and the suspension has a perforated portion of a predetermined size formed at the voice coil attachment position so as to take out the lead wire of the voice coil towards the bonding portion without interference.

8. The suspension for the sound transducer as claimed in claim 1, wherein the mold portion further comprises an additional conductive pattern layer for increasing rigidity.

9. The suspension for the sound transducer as claimed in any one of the preceding claims, wherein the suspension consists of a flexible printed circuit board (FPCB), and an FPCB pattern is formed by etching or electrodeposition.

* * * * *